United States Patent [19]

Ray

[11] Patent Number: 4,582,585

[45] **Date of Patent: * Apr. 15, 1986**

[54] INERT ELECTRODE COMPOSITION HAVING AGENT FOR CONTROLLING OXIDE GROWTH ON ELECTRODE MADE THEREFROM

[75] Inventor: Siba P. Ray, Plum Boro, Pa.

[73] Assignee: Aluminum Company of America, Pittsbugh, Pa.

[ * ] Notice: The portion of the term of this patent subsequent to Jun. 12, 2001 has been disclaimed.

[21] Appl. No.: 682,909

[22] Filed: Dec. 18, 1984

Related U.S. Application Data

[60] Continuation-in-part of Ser. No. 596,020, May 3, 1984, which is a division of Ser. No. 423,673, Sep. 27, 1982, Pat. No. 4,454,015.

[51] Int. Cl.[4] ..... C25C 3/00; C25B 11/04

[52] U.S. Cl. ..... 204/243 R; 204/292; 204/293; 419/5

[58] Field of Search ..... 204/67, 292, 293, 243 R; 419/5

[56] References Cited

U.S. PATENT DOCUMENTS 4,374,050 2/1983 Ray ..... 204/67

4,454,015 6/1984 Ray et al. ..... 204/293

4,455,211 6/1984 Ray et al. ..... 204/293

OTHER PUBLICATIONS

Rapp et al., "Metallurgical Transactions", vol. 4, May 1973, pp. 1283–1292.

*Primary Examiner*—John F. Niebling

*Attorney, Agent, or Firm*—Andrew Alexander; John P. Taylor

[57] ABSTRACT

An improved inert electrode composition is suitable for use as an inert electrode in the production of metals such as aluminum by the electrolytic reduction of metal oxide or metal salt dissolved in a molten salt bath. The composition comprises one or more metal alloys and metal compounds which may include oxides of the metals comprising the alloy. The alloy and metal compounds are interwoven in a network which provides improved electrical conductivity and mechanical strength while preserving the level of chemical inertness necessary for such an electrode to function satisfactorily. The electrode composition further includes a metal compound dopant which will aid in controlling the thickness of a protective oxide layer on at least the bottom portion of an electrode made therefrom during use.

49 Claims, 12 Drawing Figures

600X 20μ

150X 100μ

600X 20μ

600X 20μ

600X

600X

600X

600X

OXIDATION TREATMENT IN AIR AT 960°C

PARABOLIC RATE FOR OXIDATION IN AIR AT 960°C

INERT ELECTRODE COMPOSITION HAVING AGENT FOR CONTROLLING OXIDE GROWTH ON ELECTRODE MADE THEREFROM

The Government has rights in this invention pursuant to Contract No. DE-FC07-80CS40158 awarded by the Department of Energy.

CROSS REFERENCE TO RELATED APPLICATIONS

This application is a continuation-in-part of U.S. patent application Ser. No. 596,020; filed May 3, 1984, as a division of application Ser. No. 423,673; filed Sept. 27, 1982, now issued as U.S. Pat. No. 4,454,015.

BACKGROUND OF THE INVENTION

This invention relates to the production of metals such as aluminium, lead, magnesium, zinc, zirconium, titanium, silicon and the like by the electrolytic reduction of oxides or salts of the respective metals. More particularly, the invention relates to an inert type electrode composition useful in the electrolytic production of such metals.

Conventionally, metals such as aluminum, for example, are produced by electrolysis of alumina dissolved in molten salts using carbon electrodes. However, the oxygen released by the reduction of alumina reacts with the carbon electrodes to form carbon dioxide resulting in the decomposition and consumption of the carbon electrodes. As a result, about 0.33 pounds of carbon must be used for every pound of aluminum used. Carbon such as that obtained from petroleum coke is normally used for such electrodes. However, because of the increasing costs of such cokes, it has become economically attractive to find a new material for the electrodes. A desirable material would be one which would not be consumed, i.e., resistant to oxidation, and which would not be attached by the molten salt bath. In addition, the new material should be capable of providing a high energy efficiency, i.e. have a high conductivity, should not affect the purity of metal, should have good mechanical properties and should be economically acceptable with respect to the cost of raw material and with respect to fabrication.

Numerous efforts have been made to provide an inert electrode having the above characteristics but apparently without the required degree of success to make it economically feasible. That is, the inert electrodes in the art appear to be reactive to an extent which results in contamination of the metal being produced as well as consumption of the electrode. For example, U.S. Pat. No. 4,039,401 reports that extensive investigations were made to find nonconsumable electrodes for molten salt electrolysis of aluminum oxide, and that spinel structure oxides or perovskite structure oxides have excellent electronic conductivity at a temperature of 900° to 1000° C., exhibit catalytic action for generation of oxygen and exhibit chemical resistance. Also, in U.S. Pat. No. 3,960,678, there is disclosed a process for operating a cell for the electrolysis of aluminum oxide with one or more anodes, the working surface of which is of ceramic oxide material. However, according to the patent, the process requires a current density above a minimum value to be maintained over the whole anode surface which comes in contact with the molten electrolyte to minimize the corrosion of the anode. Thus, it can be seen that there remains a great need for an electrode which is substantially inert or is resistant to attack by molten salts or molten metal to avoid contamination and its attendant problems.

It has been proposed that an inert electrode be constructed using ceramic oxide compositions having a metal powder dispersed therein for the purpose of increasing the conductivity of the electrode. For example, when an electrode composition is formulated from NiO and $Fe_2O_3$, a highly suitable metal for dispersing through the composition is nickel which may increase the conductivity of the electrode by as much as 30 times.

However, it has been found that the search for inert electrode materials possessing the requisite chemical inertness and electrical conductivity is further complicated by the need to preserve certain mechanical characteristics which may be either enhanced or impaired by modifications to enhance the chemical resistance or electrical conductivity. For example, the electrode should possess certain minimum mechanical strength characteristics tested by the modulus of rupture, fracture toughness and expansion and resistance to thermal shock of the electrode material as well as the ability to weld electrical connections thereto must also be taken into account. An article entitled "Displacement Reactions in the Solid State" by R. A. Rapp et al, published May 1973, in Volume 4 of *Metallurgical Transactions,* at pages 1283–1292, points out the different morphologies which can result from the addition of a metal or metal alloy to an oxide mixture. The authors show that some additions result in layers of metal or metal oxides while others form aggregate arrangements which may be lamellar or completely interwoven. The authors suggest that interwoven-type microstructures should be ideal for the transfer of stresses and resistance to crack propagation and demonstrated that such were not fractured by rapid cooling. The authors suggested that such an interwoven structure would be useful in the preparation of porous electrodes for fuel cells or as catalysts for reactions between gases by selective dissolution of either the metal or oxide phase.

Furthermore, an inert electrode composition must be capable of functioning in an electrolytic reduction cell, such as a Hall cell, without raising the contamination level of the reduced metal product while maintaining the conductivity at an economically acceptable level.

In accordance with the invention, an inert electrode composition having improved electrical conductivity is provided by contacting a combination of metal and metal oxides, oxygen-containing compounds or metal compounds, and a metal compound dopant at an elevated temperature resulting in a displacement reaction to form an interwoven network of metal oxides and metal alloy which will aid in controlling the formation of a protective oxide layer during use. In a preferred embodiment, metal compounds which include a nickel compound, iron and an alumina dopant are reacted to form an interwoven matrix which includes oxides of nickel and iron and an alloy which contains nickel and iron and which will form a protective oxide layer during subsequent use of the coposition in an inert electrode.

DETAILED DESCRIPTION OF THE INVENTION

The invention provides an inert electrode composition suitable for use in the production of metals such as aluminum by electrolytic reduction of their oxides or salts in a molten salt bath. The electrode composition provides a high degree of chemical inertness to attack by the bath while providing good electrical conductivity and satisfactory mechanical properties. It is further characterized by the ability to form a controlled amount of a protective oxide layer at least on the bottom of an electrode made from the composition during use which reduces contamination of the reduced metal by metal ions from the electrode without lowering the conductivity of the electrode to an unacceptable level.

The electrode composition of the present invention is particularly suited for use an an anode in an aluminum producing cell. In one preferred aspect, the composition is particularly useful as an anode for a Hall cell in the production of aluminum. That is, when the anode is used, it has been found to have very high resistance to bath used in a Hall cell. For example, the electrode composition has been found to be resistant to attack by cryolite ($Na_3AlF_6$) type electrolyte baths when operated at temperatures around 950°-1000° C. Typically, such baths can have a weight ratio of NaF to $AlF_3$ in a range of about 1.0:1 to 1.4:1. Also, the electrode has been found to have outstanding resistance to lower temperature cryolite type baths where NaF/$AlF_3$ ratio can be in the range of from 0.5 up to 1.1:1. Low temperature baths may be operated typically at temperatures of about 800° to 850° C. utilizing the electrode composition of the invention. While such baths may consist only of $Al_2O_3$, NaF and $AlF_3$, it is possible to provide in the bath at least one halide compound of the alkali and alkaline earth metals other than sodium in an amount effective for reducing the operating temperature. Suitable alkali and alkaline earth metal halides are LiF, $CaF_2$ and $MgF_2$. In one embodiment, the bath can contain LiF in an amount between 1 and 15%.

Figure 1:
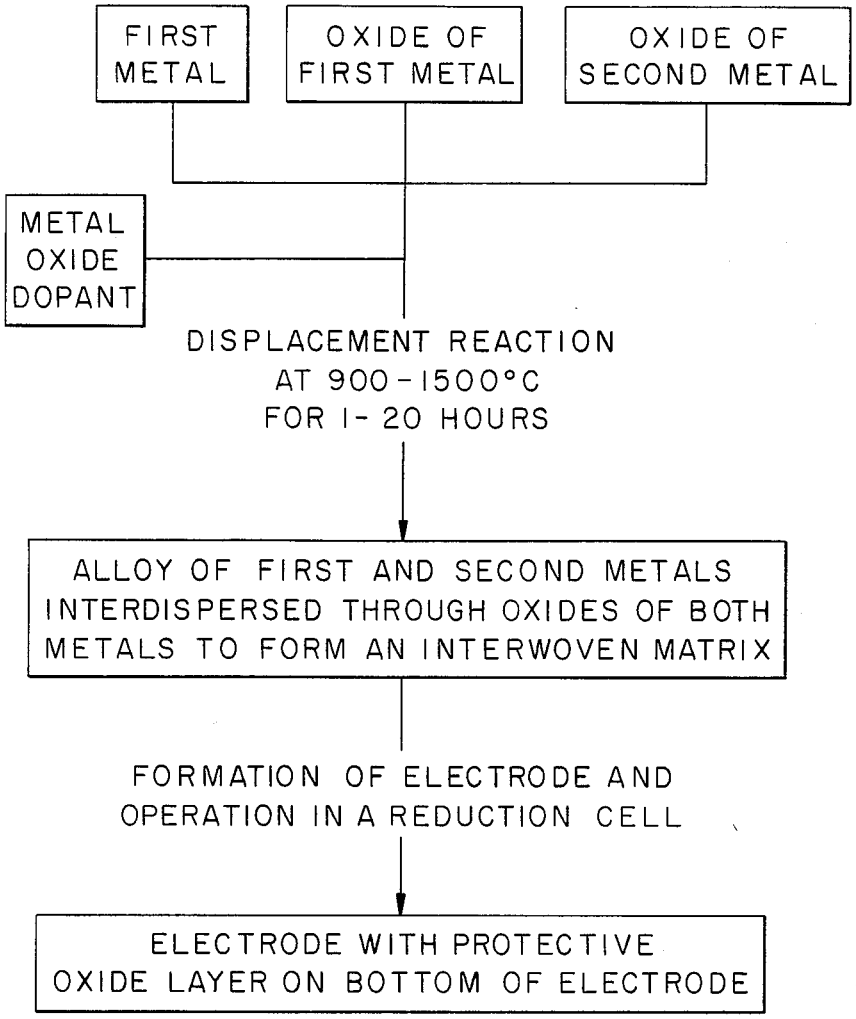
FIG. 1 is a flowsheet illustrating the invention.
Figure 2:
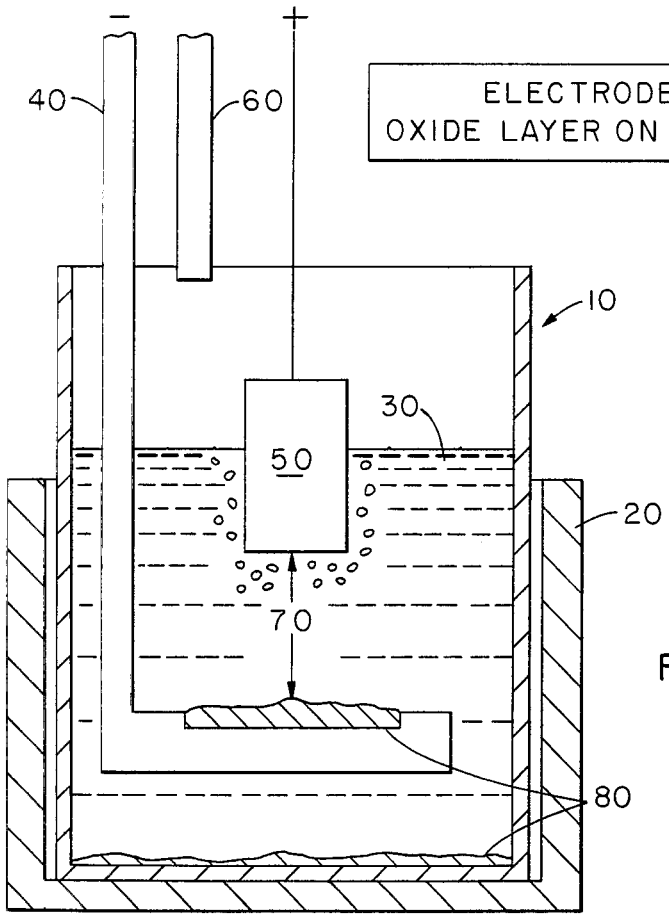
FIG. 2 is a schematic representation of an electrolytic cell showing the inert electrode of the invention being tested.
Figure 4:
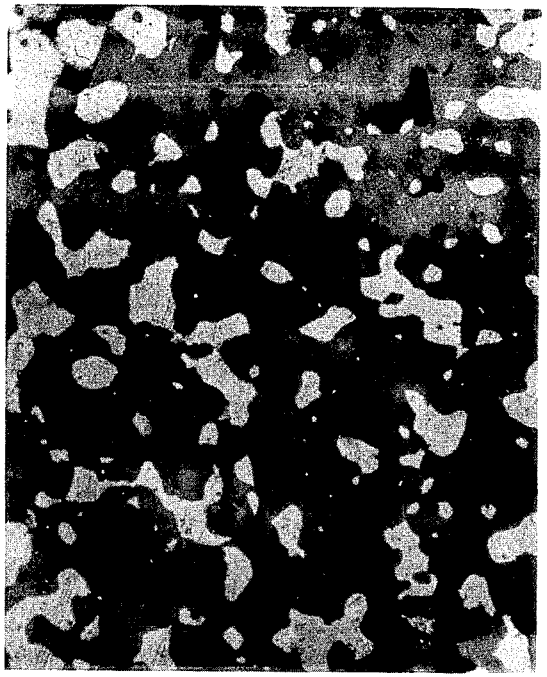
FIG. 4 is a photomicrograph at 600× of an electrode prior to oxidation containing 2 wt. % $Al_2O_3$ as an oxide controlling dopant.
Figure 3:
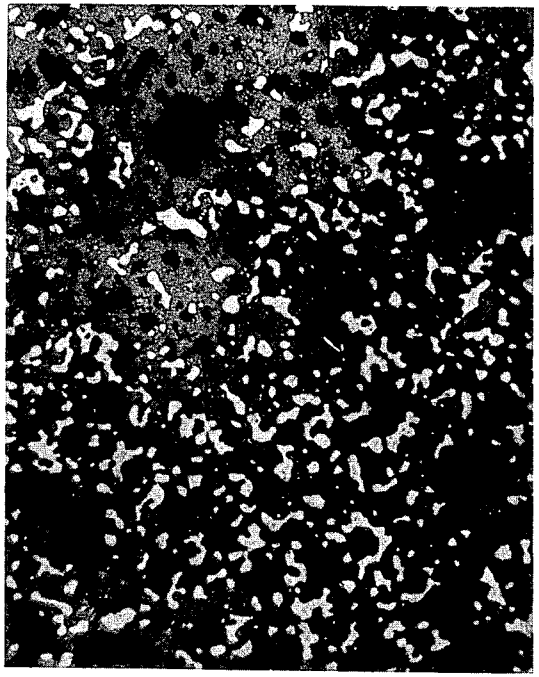
FIG. 3 is a photomicrograph at 150× of an electrode prior to oxidation containing no metal compound dopant.
Figure 6:
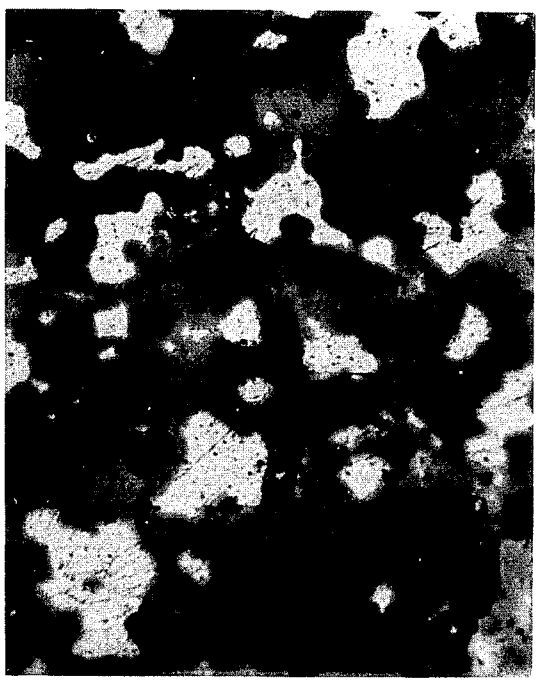
FIG. 6 is a photomicrograph at 600× of an electrode prior to oxidation containing 10 wt. % $Al_2O_3$ as an oxide controlling dopant.
Figure 5:
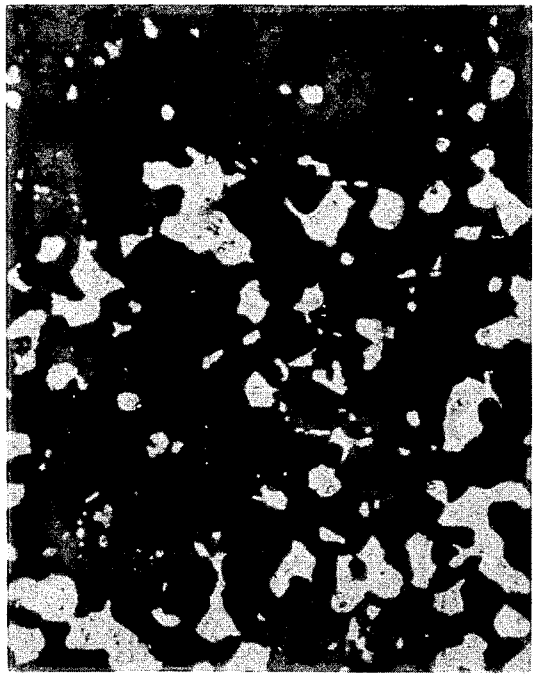
FIG. 5 is a photomicrograph at 600× of an electrode prior to oxidation containing 5 wt. % $Al_2O_3$ as an oxide controlling dopant.
Figure 8:
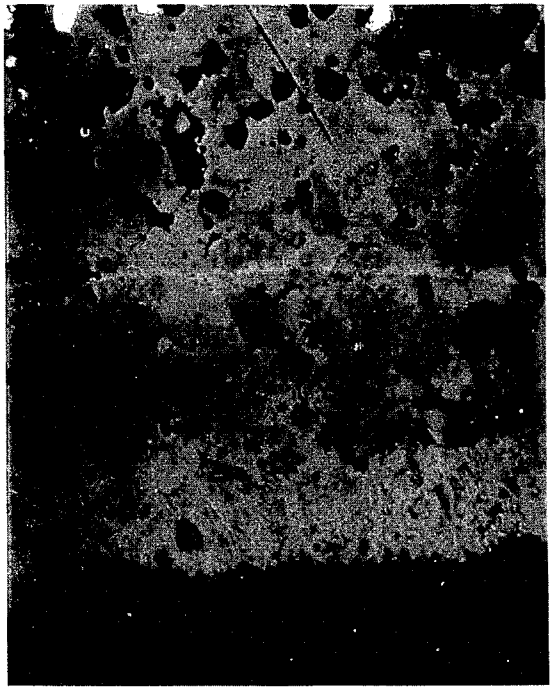
FIG. 8 is a photomicrograph at 600× of an electrode after oxidation in air for 5 days at 960° C. containing 2 wt. % $Al_2O_3$ as an oxide controlling dopant.
Figure 7:
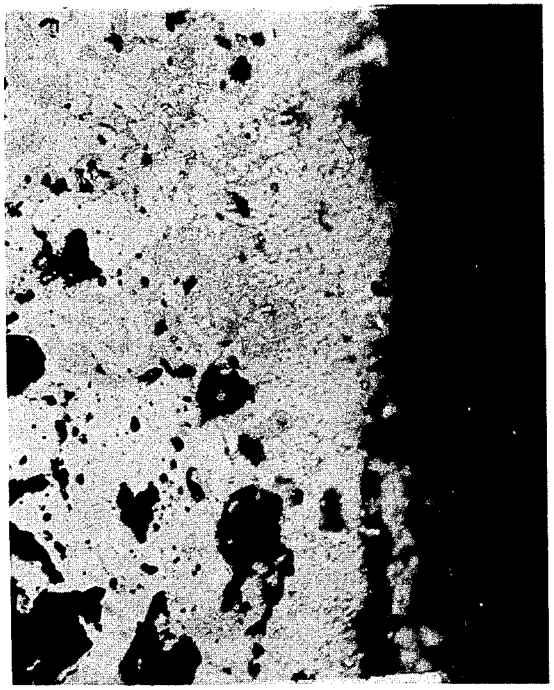
FIG. 7 is a photomicrograph at 600× of an electrode after oxidation in air for 5 days at 960° C. containing no metal compound dopant.
Figure 10:
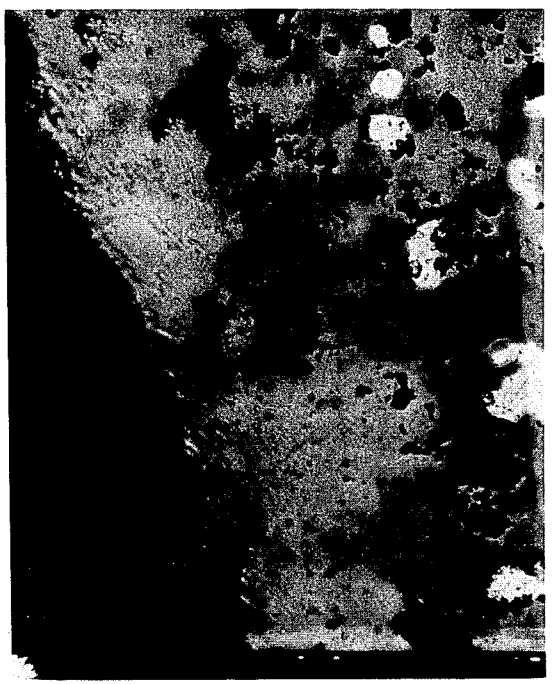
FIG. 10 is a photomicrograph at 600× of an electrode after oxidation in air for 5 days at 960° C. containing 10 wt. % $Al_2O_3$ as an oxide controlling dopant.
Figure 9:
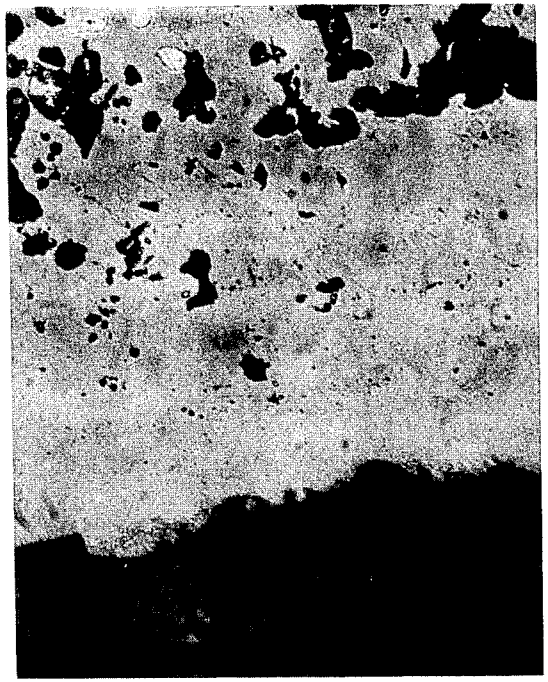
FIG. 9 is a photomicrograph at 600× of an electrode after oxidation in air for 5 days at 960° C. containing 5 wt. % $Al_2O_3$ as an oxide controlling dopant.

A cell of the type in which anodes having compositions in accordance with the invention were tested is shown in FIG. 2. In FIG. 2, there is shown an alumina crucible 10 inside a protection crucible 20. Bath 30 is provided in the alumina crucible and a cathode 40 is provided in the bath. An anode 50 having an inert electrode also in the bath is shown. Means 60 is shown for feeding alumina to the bath. The anode-cathode distance 70 is shown. Metal 80 produced during a run is represented on the cathode and on the bottom of the cell.

The novel electrode composition is formed by reacting together two or more metal-containing reactants to provide an in situ displacement reaction whereby the metal or metals in one reactant displace a certain amount of the metal in the other reactant, and the displaced metal then may form an alloy or alloys with one or more of the metals present. The first reactant is selected from the class consisting of a metal and a metal compound. The second reactant is a metal compound. In accordance with the invention, the resultant alloy or alloys or a free metal may be dispersed throughout the material in an interwoven matrix with the metal compounds resulting in a composition having enhanced electrical conductivity and mechanical strength.

Not all combinations of metals and metal compounds will, by displacement reaction, form a composition whose morphology is that of an interwoven matrix of free metal or alloy and metal compounds comprising metal salts or metal oxides. The Rapp et al article entitled "Displacement Reactions in the Solid State", previously referred to and specifically incorporated herein by reference, describes the displacement reaction of nickel and copper oxide as forming a layered product morphology consisting respectively of copper oxide, copper, nickel oxide and nickel layers. Similar reaction is disclosed for cobalt and copper oxide, while iron and copper oxide are said to form a lamellar-aggregate arrangement wherein layers of metallic copper and metallic iron are separated by a layer having a mixture of metallic copper and iron oxide.

In contrast, the displacement reaction, for example, of iron and nickel oxide results in small outer layers of iron and nickel oxide, respectively, separated by a large layer comprising what is described as two substantially completely interwoven and continuous phases or an interwoven aggregate of a nickel-iron alloy and nickel-iron oxide.

Thus, the metals and metal compounds useful in the invention include those metals and metal compounds which will react to provide free metal or form an alloy or alloys dispersed throughout the reaction product in an interwoven matrix with the resultant metal compounds resulting from the reaction.

While the invention will be illustrated by the use of one or more metals reacting with one or more metal oxides, the term "metal compounds" as used herein is intended to embrace not only metal oxides but also materials containing oxygen as well. Examples of such include, for example, oxyborides, oxynitrides and oxyhalides. In addition, the use of non-oxygen compounds such as, for example, the use of metal borides, nitrides, carbides, halides and sulfides, should also be deemed to be within the scope of the term "metal compounds" as used herein.

The initial reactants in the displacement reaction may include more than one metal as well as more than one metal compound. For example, in the preferred embodiment of the invention in which a nickel-iron alloy is interwoven with nickel-iron oxides, the reactants comprise metallic iron and oxides of both iron and nickel. This reaction can be illustrated by the following formula: $Fe+NiO+Fe_3O_4 \rightarrow$ Ni-Fe alloy $+Ni_xFe_{1-x}O+Ni_yFe_{3-y}O_4$ where $0<x<1.0$ and $0<y<1.0$ and preferably $0.6<x<1$ and $0.7<y<1$. In accordance with the invention, the resulting composition should contain 5–50 vol. % of the metal alloy or alloys, e.g. Ni-Fe alloy, preferably 10–35 vol. %, and most preferably 15–25 vol. %. The ratio of metals in the alloy or alloys may vary considerably. The metal compounds, which in the preferred embodiment comprise metal oxides, comprise the balance of the resulting composition. The metal compounds in the final composition will not necessarily be the same as the initial metal compound reactants, but may rather be complex reaction products of the displacement reaction. For example, when metallic iron is reacted with iron oxide and nickel oxide, as shown in the formula above, mixed oxides of nickel and iron are formed.

In accordance with the invention, one or more additional metal compound dopants, such as an additional metal oxide dopant, may be added to the original reactants if desired to alter some of the chemical or electrical characteristics of the resultant composition. For example, when iron is reacted with iron oxide and nickel oxide, it has been found that the resultant composition, while providing an inert electrode having satisfactory to excellent electrical and mechanical properties in an electrolytic cell, yields aluminum pot metal which may, in certain instances, have an undesirably high Fe or Ni level.

However, the use of up to 30 wt. %, preferably from 1–10 wt. %, and most preferably 1–3 wt. %, of one or more other metal compound dopants, including an oxide dopant such as, for example, compounds of Al, Mg, Ca, Co, Si, Sn, Ti, Cr, Mn, Nb, Ta, Zr, Cu, Li and Y appears to result in the formation of compounds from which the iron or the nickel component can be more difficult to leach or dissolve during subsequent function as an inert electrode in an electrolytic cell for production of metal, such as aluminum, by the forming of a controlled amount of a protective oxide layer on at least the bottom of an electrode made from the composition during use in an electrolytic cell.

The amount of metal compound dopant used should be sufficient to aid in controlling the growth of a protective oxide coating during use on at least the bottom of an electrode made from the composition sufficient to lower the level of other metal contaminants in the reduced metal without unduly lowering the conductivity of the electrode by the production of a thick oxide coating.

The initial reactants used to form the above composition should comprise 5–35 wt. % of one or more metals, preferably 5–30 wt. %, with the balance comprising one or more metal compounds. In the preferred embodiment, the reactants comprise 5–30 wt. % Fe metal, 0–25 wt. % $Fe_3O_4$, 50–70 wt. % NiO and 1–30 wt. % of one or more additional metal compound dopants, as an oxide formation controlling dopant as described above.

The reactants can be initially blended by mixing powders of the reactant screened to below 100 mesh (Tyler Series) and uniaxially die pressed at 10–30,000 psi. The initial composition is then reacted by sintering, preferably in an inert atmosphere, at from 900°–1500° C., preferably 1150°–1350° C. for a period of 1 to 20 hours. Longer periods of time could be used but are not necessary and, therefore, are not economical. If non-oxygen bearing metal compounds are used as the non-metallic reactants, a controlled oxygen atmosphere may be substituted for the inert atmosphere to permit formation in situ of a controlled amount of oxides in the final composition.

The initial reactants may also be formed into an electrode using isostatic pressing techniques well known to those skilled in the art. The electrode is then reaction sintered using the same parameters just discussed for uniaxially pressed electrodes.

In another embodiment, the reactants may be hot pressed to form the electrode while reacting the composition. In this embodiment, the powdered initial reactants are uniaxially pressed at a pressure of about 1,000 to 3,000 PSI for about 15 minutes to one hour at a temperature of about 750°–950° C. Care must be exercised, in the practice of this embodiment, in selection of die materials which will be inert to the displacement reaction taking place within the dies during the formation of the electrode. For example, the use of boron nitride-coated dies has been successfully attempted. It should be further noted here that hot isostatic pressing can also be used in this embodiment.

If desired, after formation of the novel composition of the invention, an inert electrode assembly, including connectors to be joined thereto, can be fabricated therefrom suitable for use in a cell for the electrolytic reduction of metal, such as aluminum. Ceramic fabrication procedures well known to those skilled in the art can be used to fabricate such electrodes in accordance with the present invention.

Also, in electrolytic cells, such as Hall cells, claddings of the composition of the invention may be provided on highly conductive members which may then be used as anodes. For example, a composition as defined by the formula referred to hereinabove may be sprayed, e.g. plasma sprayed, onto a conductive member to provide a coating or cladding thereon. This approach can have the advantage of lowering or reducing the length of the resistance path between the highly conductive member and the molten salt electrolyte and thereby significantly lowering the overall resistance of the cell. Highly conductive members which may be used in this application can include metals such as stainless steel, nickel, iron-nickel alloys, copper and the like whose resistance to attack by molten salt electrolyte might be considered inadequate yet whose conductive properties can be considered highly desirable. Other highly conductive members to which the composition of the invention may be applied include, in general, sintered compositions of refractory hard metals including carbon and graphite.

The thickness of the coating applied to the conductive member should be sufficient to protect the member from attack and yet be maintained thin enough to avoid unduly high resistances when electrical current is passed therethrough. Conductivity of the coating should be at least 0.01 $ohm^{-1}cm^{-1}$.

The following examples will serve to further illustrate the invention.

EXAMPLE I

A series of compositions consisting of $Fe_3O_4$, NiO, Fe metal and $Al_2O_3$ as powders of −100 mesh (Tyler Series) and in the composition ratios shown in Table I, were uniaxially die pressed at 172 MPa into 2.5 cm (1 inch) diameter rods and sintered in an argon atmosphere at 1350° C. for 14 hours.

Sample rods respectively containing 0, 2, 5 and 10 wt. % calcined alumina ($Al_2O_3$) were air oxidized at 960° C. for time periods varying from 3 to 120 hours. The thickness of the oxide layer built up on the outside of the electrode was then measured. The results are tabulated in Table I.

TABLE I

| | Wt. % Composition | | | | Layer Thickness (mm) | | |
|---|---|---|---|---|---|---|---|
| | | | | | 3 | 21 | 120 |
| Sample | Fe | NiO | $Fe_3O_4$ | $Al_2O_3$ | Hours | Hours | Hours |
| A | 20 | 60 | 20 | | 0.02 | 0.07 | 0.17 |
| B | 20 | 60 | 18 | 2 | <0.02 | 0.04 | 0.15 |
| C | 19 | 57 | 19 | 5 | <0.02 | 0.05 | 0.1–0.15 |
| D | 18 | 54 | 18 | 10 | <0.02 | — | 0.1 |

Three each of the sample rods containing respectively 2 and 5 wt. % alumina were further measured to determine the area of exposed surface as well as the weight gain. These results are shown in Table II. The results clearly indicate that the amount of oxide buildup can be controlled by the addition of alumina to the composition.

TABLE II

| Wt. % Composition | | | | Time | Exposed Surface | Weight Gain |
|---|---|---|---|---|---|---|
| Fe | NiO | $Fe_3O_4$ | $Al_2O_3$ | (Hrs.) | ($cm^2$) | (gm) |
| 19 | 57 | 19 | 5 | 3 | 6.4 | 0.0152 |
| 19 | 57 | 19 | 5 | 21 | 6.77 | 0.0154 |
| 19 | 57 | 19 | 5 | 120 | 6.21 | 0.0247 |
| 20 | 60 | 18 | 2 | 3 | 6.94 | 0.0102 |
| 20 | 60 | 18 | 2 | 21 | 6.75 | 0.0198 |
| 20 | 60 | 18 | 2 | 120 | 6.85 | 0.0399 |

FIG. 3–6 shows electrodes prior to oxidation which were made from compositions containing 0, 2, 5 and 10 wt. % alumina corresponding to samples A-D in Table I. FIGS. 7–10 show the same electrodes after air oxidation at 960° C. for 120 hours wherein the relative amounts of oxide buildup on the bottom of the respective electrodes is evident.

Figure 11:
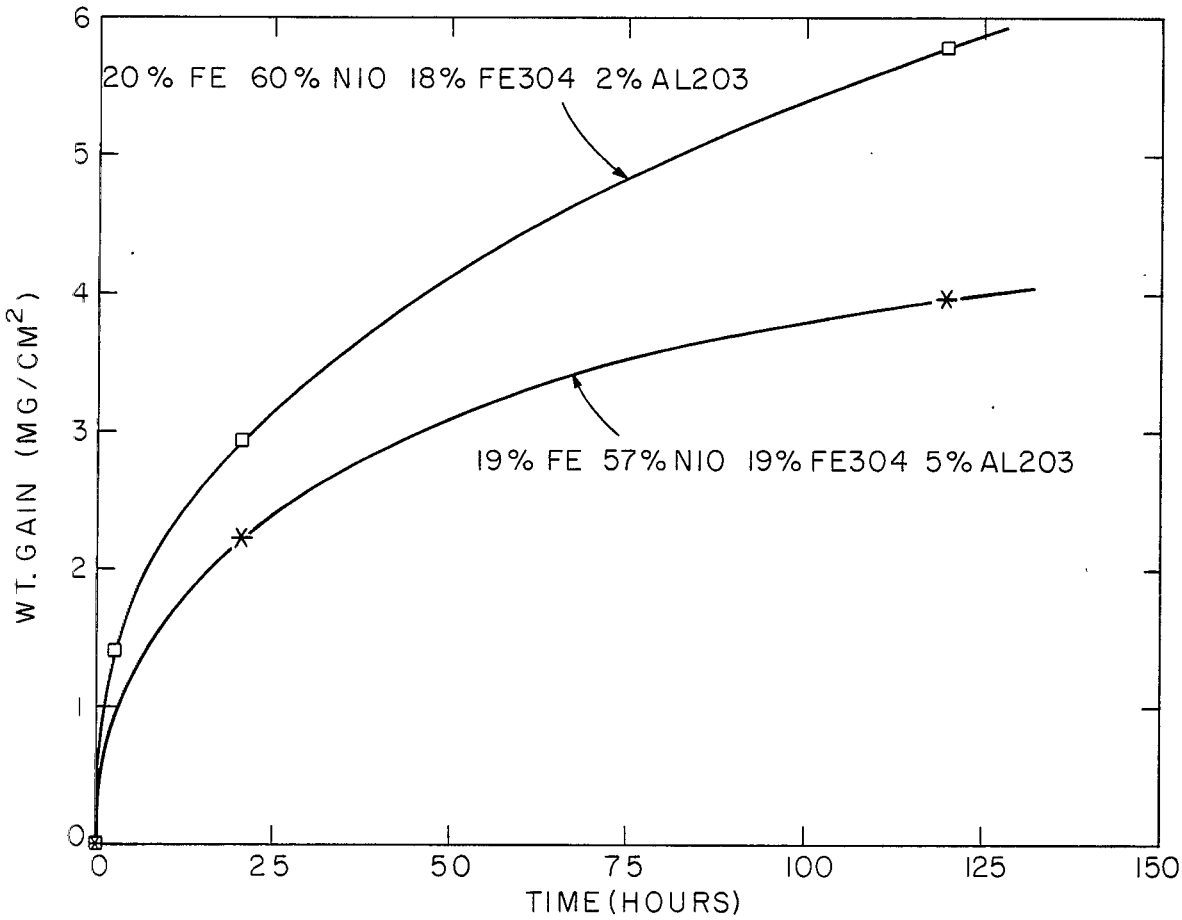
FIG. 11 is a graph plotting weight gain per area against time.
Figure 12:
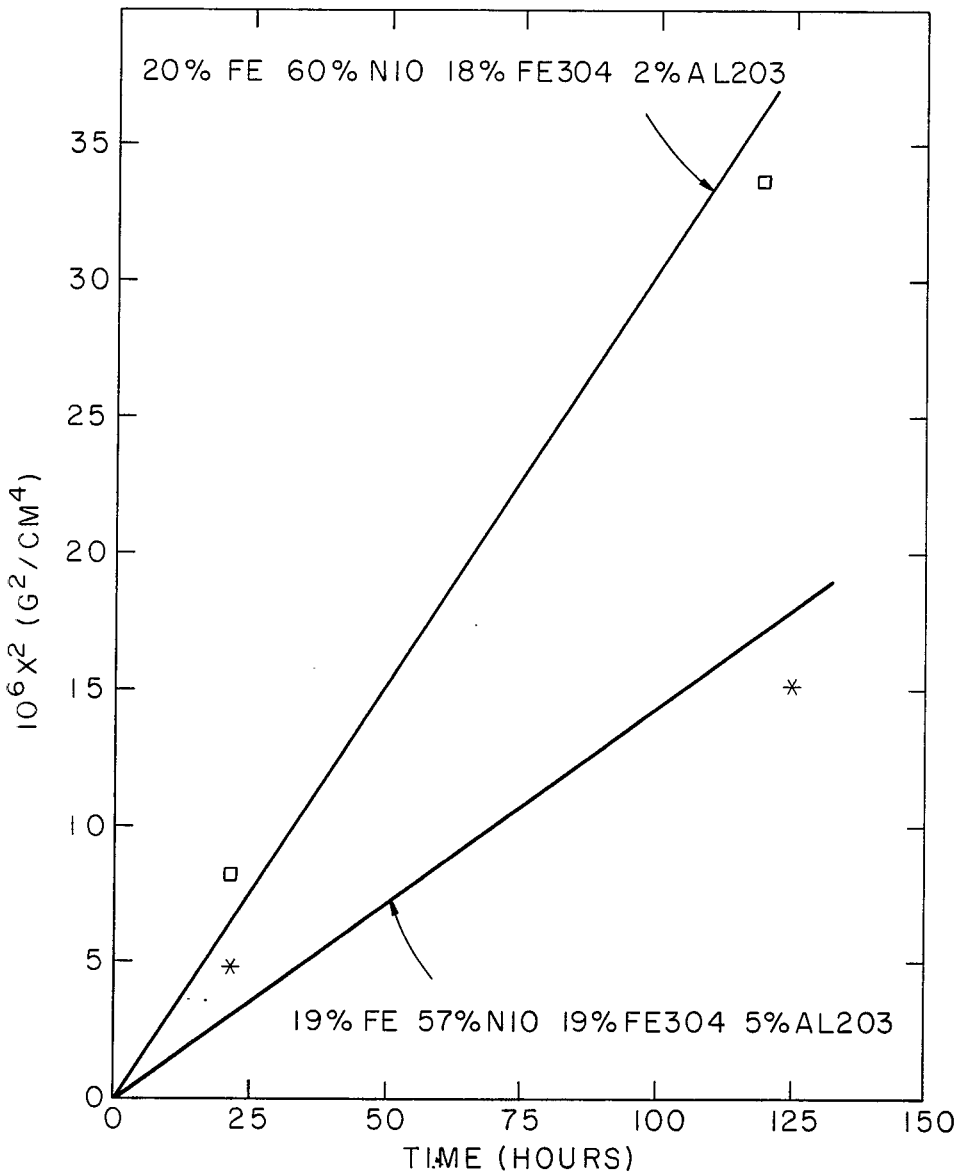
FIG. 12 is a graph plotting the square of the weight gain per area against time.

The results shown in Table II are further illustrated in the graphs of FIGS. 11 and 12. FIG. 11 plots the weight gain in milligrams per square centimeter versus hours oxidized for compositions containing 2% and 5% alumina while FIG. 12 shows the square of weight gain/area plotted against time.

EXAMPLE II

To further illustrate the invention, bench scale Hall cell tests were carried out on anodes constructed as in Example I. The bath ratio was 1:1 with 5 wt. % alumina and 5 wt. % calcium fluoride at a temperature of 960° C. The results are tabulated in Table III, including the current efficiency and an analysis of the amounts of iron and nickel pickup in aluminum produced in the respective cells. The results show the lowest iron and nickel pickup when 2 wt. % alumina is used as a dopant.

TABLE III

| Composition (wt. %) | | | | Anode Density | Run Time | Current Efficiency | Metal Analysis (wt. %) | |
|---|---|---|---|---|---|---|---|---|
| Fe | NiO | $Fe_3O_4$ | $Al_2O_3$ | (g/cc) | (Hrs.) | (%) | Fe | Ni |
| 20 | 60 | 18 | 2 | 5.51 | 44 | 87 | 0.14 | 0.015 |
| 19 | 57 | 19 | 5 | 5.27 | 52 | 84 | 0.17 | 0.03 |
| 19 | 57 | 19 | 5 | 5.33 | 51 | 89 | 0.34 | 0.09 |
| 19 | 57 | 19 | 5 | 5.27 | 17 | 25 | — | — |
| 19 | 57 | 19 | 5 | 5.48 | 72 | 68 | 0.68 | 0.18* |
| 18 | 54 | 18 | 10 | 5.04 | 70 | 95 | 0.53 | 0.26 |
| 18 | 54 | 18 | 10 | 5.02 | 52 | 92 | 0.22 | 0.11 |

*Possible Shorting with Metal Pad

Thus, the inert electrode composition of the invention possesses satisfactory chemical, mechanical and electrical properties necessary for use in the production of metal by electrolytic reduction of metal oxides or salts in a molten salt bath.

What is claimed is:

1. An inert electrode composition suitable for use in the production of metal by the electrolytic reduction of a metal compound dissolved in a molten salt, said composition comprising:

(a) an interwoven network resulting from the displacement reaction of metals and metal compounds selected from the class consisting of metals and metal compounds which can react to form said network, the interwoven network containing a metal compound and a second material selected from the class consisting of free metal or a mixture thereof; and (b) a metal compound dopant which will aid in the control of oxide formation.

2. The composition of claim 1 wherein said metal compound dopant comprises at least one metal compound selected from the class consisting of compounds of Al, Mg, Ca, Co, Si, Sn, Ti, Cr, Mn, Zr, Cu, Nb, Ta, Li and Y.

3. The inert electrode composition of claim 2 wherein said metal compound comprises a plurality of metal compounds, at least one of which includes more than one metal contained in said second member.

4. The inert electrode of claim 2 wherein at least one of said metal compounds comprises one or more oxygen-bearing compounds.

5. The inert electrode of claim 2 wherein at least one of said metal compounds comprises a metal oxide.

6. The inert electrode of claim 2 wherein at least one of said metal compounds comprises a plurality of metal oxides.

7. The inert electrode composition of claim 6 wherein more than one metal oxide is present in the composition and at least one of said oxides contains more than one of the metals present in said second member.

8. The inert electrode composition of claim 2 wherein 5 to 50 vol. % of the composition consists of said second member.

9. An inert electrode composition suitable for use in the production of metal by the electrolytic reduction of a metal compound dissolved in a molten salt, said composition comprising:

(a) at least one nickel-iron oxide with a nickel-iron alloy dispersed therethrough; and (b) an aluminum compound dopant.

10. The composition of claim 9 wherein said aluminum compound dopant comprises an aluminum oxide.

11. The composition of claim 10 wherein said aluminum oxide dopant comprises from 1 to 10 wt. % of said inert electrode composition.

12. The composition of claim 11 wherein the nickel-iron alloy content is from 5 to 50 vol. % of the composition.

13. The composition of claim 12 wherein said compound comprises at least one oxygen-bearing compound.

14. The composition of claim 12 wherein said compound comprises at least one metal oxide.

15. The composition of claim 14 wherein at least two nickel-iron oxides are present.

16. The composition of claim 15 wherein the nickel-iron oxides have the respective formulas: $Ni_xFe_{1-x}O$ and $Ni_xFe_{3-x}O_4$.

17. The composition of claim 16 wherein the ratios of alloy and oxides are: 5 to 50 vol. % alloy, 0 to 30 vol. % $Ni_xFe_{1-x}O$ and the balance $Ni_xFe_{3-x}O_4$.

18. The composition of claim 17 wherein the alloy content is from 15 to 25 vol. % of the composition.

19. An inert electrode composition suitable for use in the production of metal by electrolytic reduction of a metal compound dissolved in a molten salt comprising a mixture of nickel-iron alloy interdispersed to form an interwoven network of oxide and alloy; and a metal compound dopant to aid in control of oxide growth during said metal production on an inert electrode formed from said inert electrode composition; to provide an electrode material characterized by chemical inertness, good electrical conductivity and mechanical strength including resistance to thermal shock.

20. The composition of claim 19 wherein said metal compound dopant comprises at least one metal compound selected from the class consisting of compounds of Al, Mg, Ca, Co, Si, Sn, Ti, Cr, Mn, Zr, Cu, Nb, Ta, Li and Y.

21. The composition of claim 20 wherein said metal compound dopant comprises 1 to 30 wt. % of said inert electrode composition.

22. The composition of claim 21 wherein said metal compound dopant contains at least one oxygen-bearing compound.

23. The composition of claim 22 wherein at least one of said oxygen-bearing compounds is an oxide.

24. The composition of claim 23 wherein said metal oxide dopant comprises 1 to 10 wt. % aluminum oxide.

25. The composition of claim 24 wherein said aluminum oxide dopant comprises 1 to 3 wt. % of said inert electrode composition.

26. The composition of claim 25 wherein said nickel-iron alloy comprises 10 to 35 vol. % and said nickel-iron oxides comprise 0 to 30 vol. % $Ni_xFe_{1-x}O$ with the balance $Ni_yFe_{3-y}O_4$ where $0<x$ or $y<1.0$.

27. The composition of claim 26 wherein the oxides and alloy are the displacement reaction product of reacting metallic iron with iron oxide and nickel oxide at an evaluated temperature.

28. The composition of claim 27 wherein the reactants are sintered at a temperature above 900° C. in an inert atmosphere.

29. The composition of claim 28 wherein the reactants are sintered at a temperature in the range of 900° to 1500° C.

30. The composition of claim 29 wherein the reactants consist essentially of NiO, metallic iron and one or more iron oxides selected from the class consisting of FeO, $Fe_2O_3$ and $Fe_3O_4$.

31. The composition of claim 30 wherein the reactants produce, after sintering, a displacement reaction product consisting essentially of about 8 to 10 vol. % $Ni_xFe_{1-x}O$, 20 to 22 vol. % nickel-iron alloy and 68 to 70 vol. % $Ni_yFe_{3-y}O_4$ where $0<x$ or $y<1$.

32. The composition of claim 31 wherein the weight ratio of nickel to iron in the alloy is approximately in the range of 9:1 to 99:1.

33. The composition of claim 31 wherein $0.6<x<1$ and $0.7<y<1$.

34. An inert electrode composition comprising the reaction products of initial reactants provided in a mix comprised of a metal, at least one metal compound, and a metal compound dopant which will aid in the control of oxide formation during use on an inert electrode made from said inert electrode composition, the metal being present in the mix from about 5 to 35 wt. %, the reactants being selected from the class consisting of a metal and at least one metal compound which can react to form said interwoven network of at least one metal compound and a metal alloy.

35. The electrode composition in accordance with claim 34 wherein the metal is present from about 5 to 30 wt. %.

36. The electrode composition in accordance with claim 34 wherein the metal is iron and nickel.

37. The electrode composition in accordance with claim 34 wherein the compound is a metal oxide.

38. The electrode composition in accordance with claim 37 wherein the metal oxide is iron oxide and nickel oxide.

39. The electrode composition in accordance with claim 38 wherein the iron oxide is present from 0 to 25 wt. %.

40. The electrode composition in accordance with claim 39 wherein the metal oxide is present from about 50 to 70 wt. %.

41. An inert electrode composition comprising the reaction products of initial reactions provided in a mix comprised of 5 to 30 wt. % iron; 0 to 25 wt. % $Fe_3O_4$; 50 to 70 wt. % NiO and 1 to 30 wt. % of one or more additional metal compound oxide formation controlling dopants, the reactants forming an interwoven network of at least one metal oxide and a metal alloy.

42. An electrolytic cell for the production of metal by the electrolytic reduction of a metal compound dissolved in a molten salt comprising:

(a) a vessel which will retain retaining molten metal compounds therein; and (b) at least two electrodes in contact with a molten compound within said vessel, each of said electrodes being in electrical communication with a source of electrical power, at least one of said electrodes comprising an inert electrode formed from an inert electrode composition having a metal compound dopant therein which will aid in the control of oxide growth on said electrode during operation of said cell, said inert electrode composition comprising the reaction product of at least one preselected metal compound and a reactant selected from the class consisting of a metal and a metal compound which will react with said preselected metal compound to form an interwoven network of at least one metal compound and either a metal alloy or free metal.

43. The cell of claim 42 wherein said metal compound dopant comprises from 1 to 10 wt. % aluminum oxide.

44. The inert electrode composition of claim 43 wherein the preselected metal compound comprises a plurality of metal compounds, at least one of the metals from said metal compounds being contained in said alloy.

45. The inert electrode composition of claim 43 wherein at least one of said preselected metal compounds comprises one or more oxygen-bearing compounds.

46. The inert electrode composition of claim 43 wherein at least one of said metal compounds comprises a metal oxide.

47. The inert electrode composition of claim 43 wherein at least one of said metal compounds comprises a plurality of metal oxides.

48. The inert electrode composition of claim 47 wherein more than one metal oxide is present in the composition and at least one of said oxides contains more than one of the metals present in the alloy.

49. The inert electrode composition of claim 43 wherein 5 to 50 vol. % of the composition consists of the metal alloy.

* * * * *